US005779146A

United States Patent [19]

Cutler

[11] Patent Number: 5,779,146

[45] Date of Patent: Jul. 14, 1998

[54] DECORATIVE FLUID DISCHARGING FIXTURES WITH SELECTIVELY INTERCHANGEABLE INSERT

[76] Inventor: Paul F. Cutler, R.D. #3, Box 920, Rte. 517, Hackettstown, N.J. 07840

[21] Appl. No.: 568,170

[22] Filed: Dec. 6, 1995

[51] Int. Cl.[6] ..... B67D 5/08

[52] U.S. Cl. ..... 239/71; 239/289

[58] Field of Search ..... 239/107, 212, 239/288, 289, 288.5, 460, 590.3, 602, 71, 109; 23/213, 222, 227, 233, 256; 40/310, 324, 334, 661

[56] References Cited

U.S. PATENT DOCUMENTS

| | | | |
|---|---|---|---|
| D. 224,532 | 8/1972 | Michels . | |
| D. 234,198 | 1/1975 | LaRueDuBois . | |
| D. 341,874 | 11/1993 | Meilman . | |
| D. 361,120 | 8/1995 | Fan . | |
| 2,645,116 | 7/1953 | Baxter . | |
| 2,945,314 | 7/1960 | Baldwin | 40/324 |
| 3,191,329 | 6/1965 | Shea | 40/334 |
| 3,315,395 | 4/1967 | Kirklen | 40/334 |
| 4,272,002 | 6/1981 | Evans | 239/107 |
| 4,272,022 | 6/1981 | Evans . | |
| 4,821,960 | 4/1989 | Goldman . | |
| 4,928,412 | 5/1990 | Nishiyama | 40/324 |
| 4,979,325 | 12/1990 | White | 40/324 X |
| 5,172,860 | 12/1992 | Yuch . | |
| 5,275,277 | 1/1994 | Gallegos | 40/324 X |
| 5,337,956 | 8/1994 | Crutcher . | |
| 5,381,957 | 1/1995 | Bianco | 239/71 X |
| 5,553,735 | 9/1996 | Kimura | 40/324 X |

*Primary Examiner*—Andres Kashnikow
*Assistant Examiner*—Steven J. Ganey
*Attorney, Agent, or Firm*—Lerner, David, Littenberg, Krumholz, & Mentlik

[57] ABSTRACT

A decorative fluid discharging fixture has a housing, a portion of which is generally translucent, a generally fluid-tight receiving chamber, and a selective and interchangeable insert element which is inserted in the housing by the user so as to be visible from the outside of the housing. The construction of a faucet handle for receiving an insert element is also disclosed. The insert element may include any type of decorative material, such as rug clippings, wallpaper, fabric, or window dressing material, that are used in the surrounding room so that the decorative fluid discharging fixture can coordinate with the overall motif or decor of the room.

24 Claims, 4 Drawing Sheets

SH
10
2
8
12
14
16
17
17a
18a
18b
19
20
21
22
24
26
28
30

DECORATIVE FLUID DISCHARGING FIXTURES WITH SELECTIVELY INTERCHANGEABLE INSERT

FIELD OF THE INVENTION

The present invention relates generally to decorative fluid discharging fixtures, and more particularly, to decorative shower or faucet heads with selectable and interchangeable inserts which are insertable into a generally fluid-tight receiving chamber within the shower or faucet head and visible without the shower or faucet head. In addition, the present invention relates generally to the construction of faucet handles having a generally fluid-tight chamber for receiving decorative inserts and the like. This enables the decorative coordination of the faucet heads and faucet handles within a given area.

BACKGROUND OF THE INVENTION

A number of types of fluid discharging fixtures such as decorative shower or faucet heads, as well as faucet handles, are known in the art. They are typically used in kitchens, bathrooms, shower stalls and bathtub/shower combination units to disburse a supply of water into a series of jet streams, with the added feature of accentuating a room's motif or decor. It is often desirable to provide decorative kitchen or bathroom fixtures, such as decorative shower or faucet heads, which coordinate with the existing decor of the room or can be easily adapted to the future decor of the room. Numerous attempts have been made to create low cost, selectable and interchangeable decorative shower and faucet heads which decoratively coordinate with the present and future surrounding decor of the room. However, most attempts have been unsatisfactory because of a number of problems.

One such problem exists with at least one type of decorative shower head currently being sold. The known shower head consists of a solid, non-removable, internal structure which is incapable of receiving an insert to coordinate with either present or future room decor. In fact, if a new look is desired, or the surrounding room has been redecorated and the existing decorative shower head clashes, the only solution is to completely replace the decorative shower head, resulting in unnecessary costs, time and aggravation for the user.

Additional problems, such as inconvenience, time and costs spent in replacing various parts of a decorative shower or faucet head in order to achieve a coordinated decorative look have not previously been resolved. This includes the ability to select a coordinating match of the surrounding room's decor without being limited to the decorative, interchangeable heads supplied or available with the shower or faucet head. For example, many people desire to incorporate rug pieces, wall paper, tile, window treatment material, etc., from the room where the decorative shower or faucet head is to be located to coordinate the shower or faucet head with these items.

Furthermore, many decorative shower or faucet heads are covered on the outside with a desired coordinating piece. The previously mentioned decorative pieces could not be used as outside coverings without being damaged or completely destroyed by the back splash or direct stream of fluid being dispensed from the shower or faucet head, in addition to the steam that is generated by someone taking a hot shower.

Previous attempts to provide decorative shower heads include U.S. Pat. No. 4,272,022, which is directed to a shower head including a replaceable and removable decorative cover. Specifically, the decorative cover is coaxially disposed about the spray director to provide an attractive decorative shower head. The outside decorative cover is interchangeable to match the shower head to a certain decorative motif, and is installed by sliding the cover into place and snapping an end plate on the outlet of the spray director. In addition to being colored, the transparent acrylic cover can be used to show the decorative facets on the interior surface of the cover. The cover may be the same or different from the color of the end plate. This shower head requires multiple pieces which must be supplied by the manufacturer of the shower head. This limits the range and accuracy of the user's choice of shower heads to coordinate with the present or future decor of the room. The user is limited to the imagination and limitation of the manufacturer for the colors, patterns, etc., which can be used with the shower head.

U.S. Pat. No. D 341,874 discloses decorative shower heads which have patterned designs on the outside shell of the decorative shower head assembly. The material used to make the patterned designs must be of a type not effected by fluid. U.S. Pat. No. 4,821,960 discloses a covering for a decorative shower head which is securely attached and mounted on the outside of the decorative shower head, where the covering is again exposed to the back splash, direct stream or steam buildup of the dispensing fluid.

The decorative shower head concept to coordinate the shower head with the surrounding room's decor is equally applicable to decorative faucet heads for bath tubs or sinks, for example. The same problems inherent with decorative shower head designs described above are present in those faucet heads currently being manufactured and sold. Namely, complete user selectability and interchangeability of decorative aspects of the faucet head are limited to that which is provided by the manufacturer. In addition, the material used must withstand the exposure to the wet and steamy conditions indicative of shower stalls and bathrooms. Whenever the term "shower head", alone, is used to describe a decorative fluid discharging fixture, it equally applies to faucet heads as well.

Consequently, there is a need for a decorative shower or faucet head which is easily adaptable to the present as well as future decor of a surrounding room, where decorative features of the shower or faucet head are independent of any piece or part of the shower or faucet head and, where the decorating elements are selectively and interchangeably insertable in a generally fluid-tight chamber inside the housing of the shower or faucet head, visible from the outside of the housing.

There is likewise a need for a low-cost, efficient, and exacting way to incorporate existing and future decorative material, such as wallpaper or other colored or patterned paper, rug clippings, tile pieces or window dressing material inside the decorative shower or faucet head, where such material is protected from flowing fluid and steam and visible from the outside of the housing of the decorative shower or faucet head. This all should be accomplished without having to replace the decorative shower or faucet head or coverings each time a person wishes to change the decor of the surrounding room and/or the look of the decorative shower or faucet head.

SUMMARY OF THE INVENTION

The present invention is broadly directed to a decorative fluid discharging fixture comprising a housing having a fluid conducting passage extending therethrough for discharging a fluid at one end thereof, and means within the housing forming a generally fluid-tight receiving chamber visible from the exterior of the fixture through a portion of the housing, the receiving chamber being accessible from outside the housing whereby an insert element may be removably disposed within the receiving chamber while being visible from the exterior of the fixture.

The present invention is more narrowly directed to a decorative shower or faucet head comprising a housing element having a translucent portion and a pair of spaced apart open ends, one of the open ends connectable to a fluid source, the housing element having a hollow cylindrical first member attached within the housing element to the one open end to receive fluid from the source, an end cap having a fluid discharge first end and a second end detachably connectable to the other open end of the housing element, the end cap having a hollow cylindrical second member attached thereto for receiving fluid from the first member, the first and second members connectable to each other to form a fluid passageway from the fluid source to the discharge end of the end cap and a generally fluid-tight annular receiving chamber with the translucent portion of the housing when the end cap is attached to the other end of the housing element, and at least one decorative insert element removably disposable within the receiving chamber through the other open end of the housing element thereby being visible from the exterior of the fixture through the translucent portion of the housing element.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE PREFERRED EMBODIMENT

Figures 1, 2, 3:
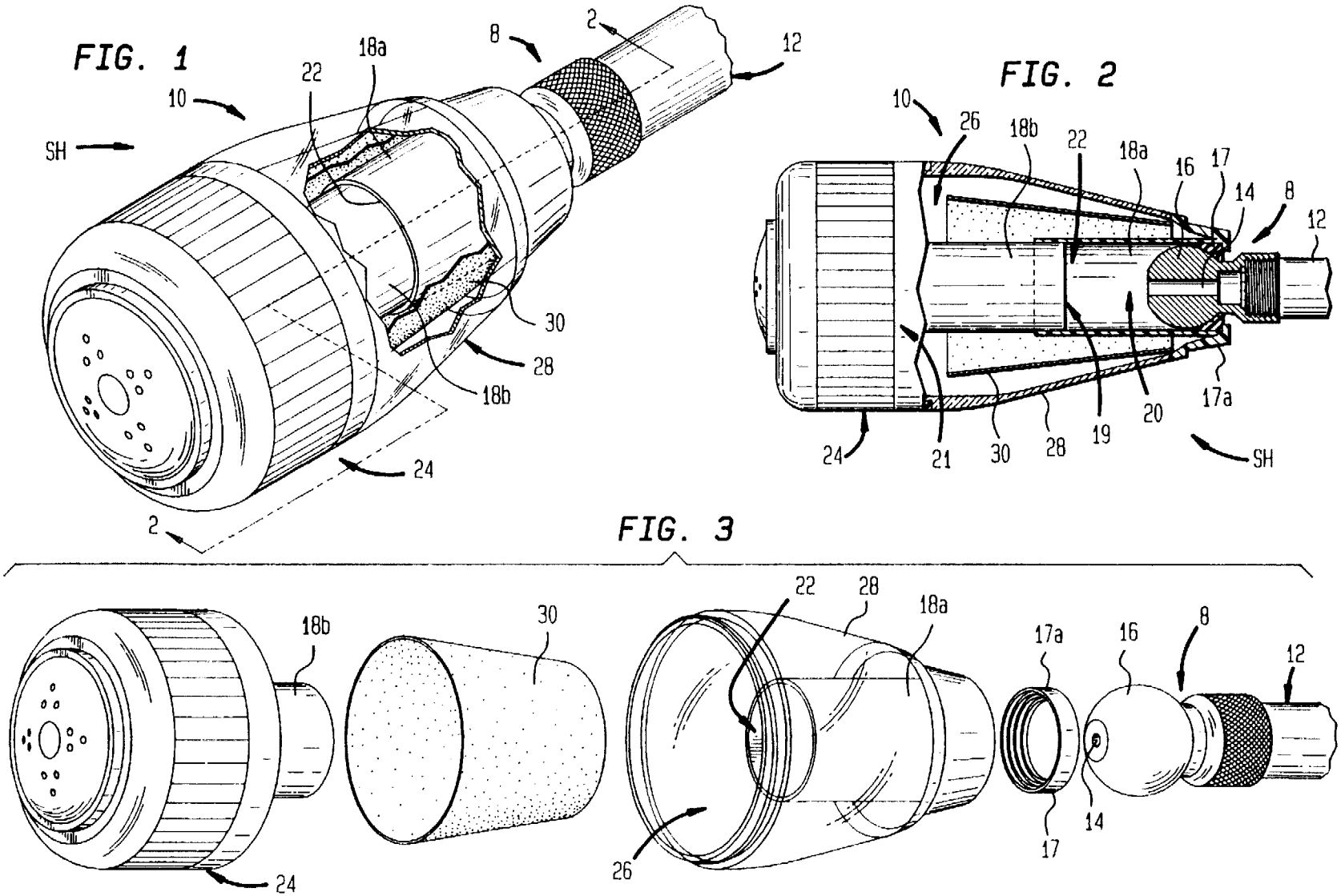
FIG. 1 is a perspective view of a decorative shower head in accordance with the present invention with a section cut-away to show the interior thereof.
FIG. 2 is a side, elevated view, partially in cross-section, along line 2—2 of FIG. 1.
FIG. 3 is an exploded perspective view showing the coordinating elements of the decorative shower head of FIG. 1 in accordance with the present invention.

Referring to the figures, a decorative shower head in accordance with one embodiment of the present invention generally designated SH is shown, and includes a ball joint 8 and a housing 10. The ball joint 8 is secured at one end to a supply pipe 12 for a source of fluid and has a bore 14 extending end to end therethrough in communication with and to receive incoming fluid from the supply pipe 12. A ball 16, formed on an opposite end of the ball joint 8, is swivelably and rotatably connected to the housing 10. The bore 14 extends through the ball 16 to further supply fluid downstream.

An annular rubber-type grommet 17 is located between the ball 16 and the portion, as at 17*a*, of the housing 10 which surrounds the ball joint 8, and provides a generally fluid-tight seal. A first fluid-conducting passage 18*a*, formed from a hollow cylindrical member, is moldably attached to the housing 10 and seated about the grommet 17. The first fluid-conducting passage 18*a* has an inlet 20 in communication with and to receive incoming fluid from the bore 14 in the ball 16 and an outlet 22 formed remote from the end of the ball joint 8 which supplies fluid to the interior of the housing 10.

The first fluid-conducting passage 18*a* concentrically surrounds and is in communication with a second fluid-conducting passage 18*b*, also formed from a hollow cylindrical member, having an inlet 19 and an outlet 21 (not shown) to provide a generally fluid-tight sealing relationship and to further the downstream supply of fluid. The fluid is generally water but can be any other type of appropriate fluid with similar characteristics to that of water. The first and second fluid-conducting passages 18*a* and 18*b* are generally cylindrical in shape, having a smaller diameter than the housing 10 so as to provide a generally annular area of space which forms the receiving chamber 26. The first and second fluid-conducting passages 18*a* and 18*b* are made of a polymer or any other type of solid material which is impervious to, and capable of conducting, fluid.

As shown in FIG. 3, the first fluid-conducting passage segment 18*a* communicates with the ball 16 of the ball joint 8 and is attached to the end of the housing 10 that communicates with the ball joint 8, and is axially disposed within the housing 10. The second fluid-conducting passage segment 18*b* is attached to an end cap 24 of the housing 10, where the end cap 24 is detachably connectable to and communicates with the open end of the remaining portion of the housing. The first fluid-conducting passage 18*a* communicates at its outlet 22 and slideably connects with the second fluid-conducting passage 18*b* at its inlet 19 via their generally cylindrical members when the detachable end cap 24 is in assembled position. The end cap 24 can also be threadably detachable to the open end of the remaining portion of the housing 10 remote from the end connected to the ball 16 and forms therewith a generally fluid-tight receiving chamber 26.

The housing 10, has a generally conical shape and flares outwardly from the end connected to the ball 16 to where the end cap 24 is connected, is swivelably mounted about the ball joint 8, and is coaxially disposed about the ball 16 and the first fluid-conducting passage 18*a* and the second fluid-conducting passage 18*b* to define the generally fluid-tight receiving chamber 26. While this preferred embodiment shows a generally conical housing 10, those skilled in the art of shower head designs will understand that the housing 10 can be made of any number of shapes not limited to that disclosed in this preferred embodiment of the present invention.

The housing 10 is made of an acrylic-type material, but other suitable plastic or polymer material is appropriate. The housing 10 has at least one translucent portion 28 which allows for visibility of the receiving chamber 26.

The receiving chamber 26 is generally annular in shape and is the void in which a selective and interchangeable insert element 30 is disposed. The insert element 30 is disposed within the receiving chamber 26 so that in assembled position the insert element will be visible from the outside of the housing 10. While this preferred embodiment, as described, discloses a translucent portion, it is meant to equally include at least one transparent portion to visibly display the insert element 30.

The housing 10 has several functions including protecting the selective and interchangeable insert element 30 from exposure to the ambient conditions in a shower stall or bathtub/shower combination unit when the decorative shower head SH is in operation.

The end cap 24 portion of the housing 10 is shaped so as to be detachably connected to the open end, translucent portion 28, of the housing. For this preferred embodiment, the end cap 24 is generally circular and sized to be threadably and detachably connected to the generally conical open end of the housing 10. The end cap 24 is made of the same or similar material as the remaining portion of the housing, i.e., an acrylic-type material or any other suitable material. The end cap 24 functions to form the generally fluid-type receiving chamber 26 and to disperse downstream fluid to the user.

The selective and interchangeable insert element 30 is generally shaped to fit in the receiving chamber 26. The insert element 30 can be made of any material selected by the user to decoratively coordinate with the remaining parts of the room where the decorative shower head is operated. The material includes, but is not limited to, wallpaper pieces, rug remnants or shavings, colored beads, pieces of tile, swatches of window dressing material such as curtains or drapes, or any other type of colored or printed patterned paper and/or material which serves to accentuate and coordinate the remaining decor of the surrounding area. The insert element 30 is assembled in the receiving chamber 26 to be visible while disposed within the housing 10 through the at least one translucent portion 28. The insert element 30 is inserted and assembled in the receiving chamber 26 by first detaching the end cap 24 portion of the housing 10 from the open end of the housing, inserting the insert element 30 so as to be visible from the outside of the housing in assembled position, and reattaching the threadably detachable end cap portion of the housing.

Once the operation of inserting the selective and interchangeable insert element 30 into the receiving chamber 26 has been completed, the receiving chamber 26 remains generally fluid-tight and thereby protects the insert element from fluid damage or complete destruction.

In another embodiment of the present invention, all of the elements mentioned above are the same except that the housing 10 is threadably detachable at the ball joint 8 end; the fluid-conducting passage 18 is one piece and is connected at the remote end of the housing 10; and the end cap 24 is moldably connected to the housing 10 and permanently sealed so as to form the generally fluid-tight receiving chamber 26. All shapes and material used are generally the same as those in the preferred embodiment and again not limited to those shapes and sizes.

In this embodiment, the selective and interchangeable insert element 30 is inserted into the receiving chamber 26 by first detaching the housing 10 from the ball joint 8. Once removed, the housing 10 is open to receive insert element 30. The insert element 30 is inserted when this opening is formed by separation of the entire housing 10 and assembled to be visible through the at least one translucent portion 28 of the housing 10. The housing 10 is then reattached to the ball joint 8.

The above-described embodiments of the present invention have many advantages, including a cost effective, time efficient, and user-selective means to coordinate a decorative shower head with other motif or decor of the associated room. This can be done without having to purchase future and other decorative shower heads and/or coverings each time a user wishes to change the decor. The above-described embodiments also allow the user to independently select an exact match of insert elements which are not limited to that produced by other manufacturers of decorative shower heads. The present invention may be sold as a kit where insert elements are provided for the user's convenience. However, it is not necessary to limit the selection from those insert elements provided by the manufacturer.

A further advantage is that the selective and interchangeable insert 30 inserted into the receiving chamber 26 of the housing 10 is generally protected from any fluid flowing through the decorative shower head. Therefore, the insert element can be any type of material including paper, cloth, woven material, or any other type of material which is generally used in a room where a decorative shower head is operated.

The above discussion and description of the decorative shower head SH is equally applicable to another embodiment of the present invention adaptable for kitchen sink, bathroom sink or bathtub faucet heads. While these faucet heads are shown in the drawings as being generally detachable from a ball joint 8, they may also be removably detachable from a faucet end without a ball joint but, rather, a straight pipe.

Figure 4:
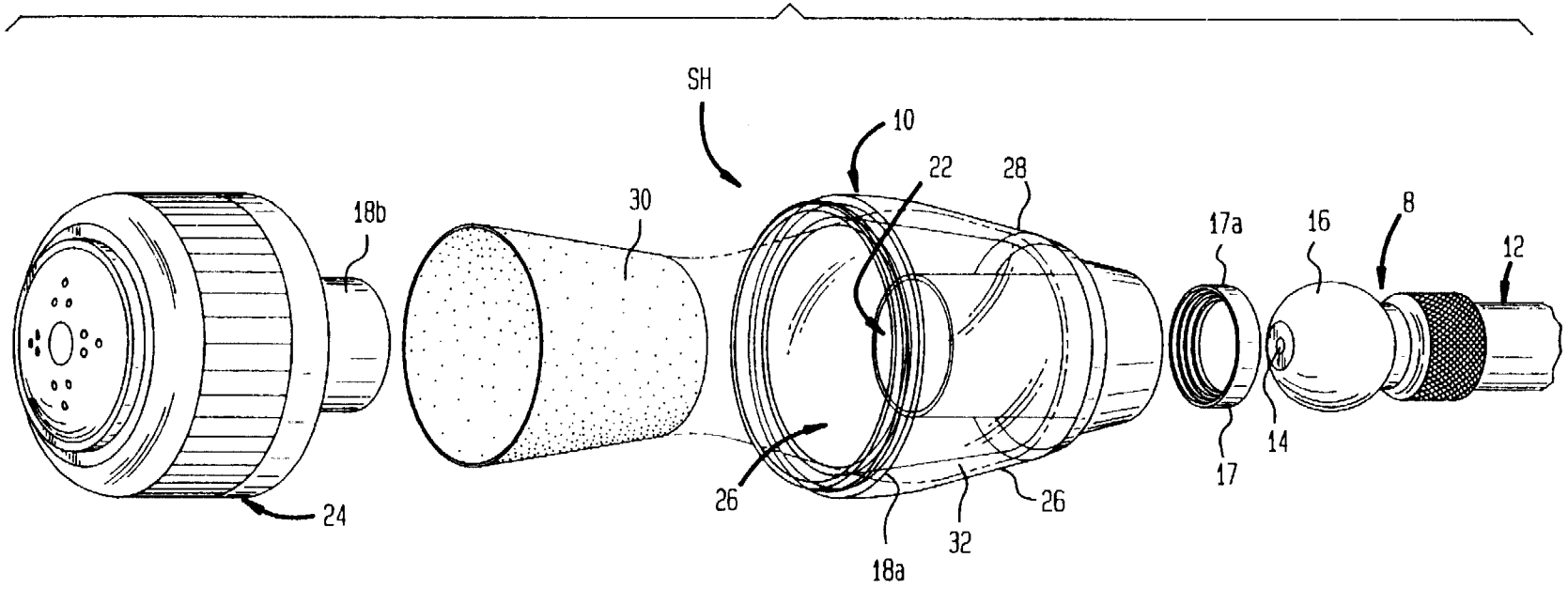
FIG. 4 is an exploded perspective view showing the coordinating elements of a decorative shower head in accordance with another embodiment of the present invention.

Referring now to FIG. 4, there is disclosed another embodiment of a decorative shower head generally designated SH in accordance with another embodiment of the present invention. The shower head SH differs over the shower head shown in FIGS. 1–3 by the inclusion of a cylindrical inner shell 32. The inner shell 32 is attached to and extends from that portion of the housing 10 surrounding the first fluid-conducting passage 18*a*. The inner shell 32 forms an annular receiving chamber 26 with respect to the translucent portion 28 of the housing 10. The interchangeable insert element 30 may be positioned within the receiving chamber 26 upon removal of the end cap 24. The insert element 30 will be visible from outside the housing 10 through the translucent portion 28. The inner shell 32, although preferably made from the same material as the housing 10, e.g., acrylic-type material, is not required to be translucent. Except for the aforementioned differences, the shower head SH disclosed and described with respect to FIG. 4 is otherwise similar in construction and operation to the shower head shown and described with respect to FIGS. 1–3.

Figure 7:
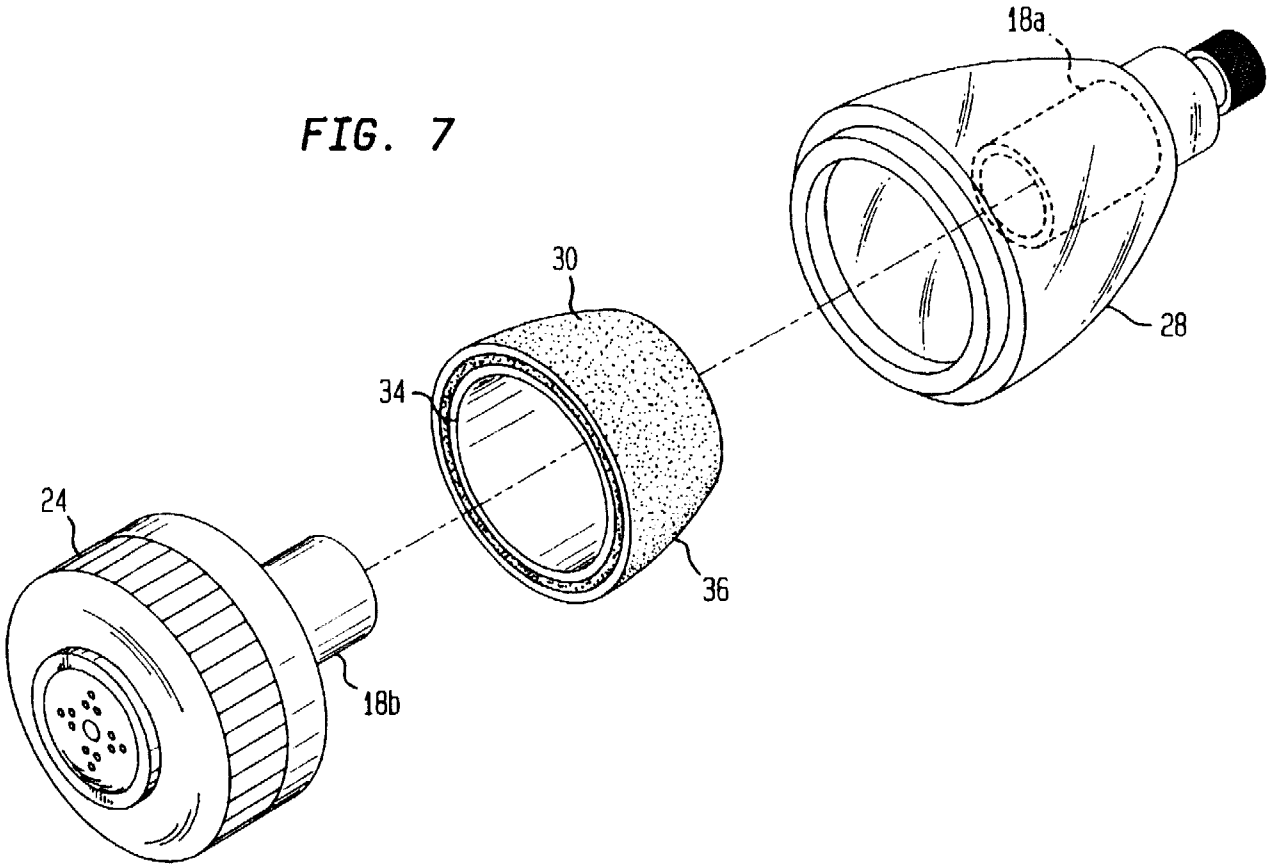
FIG. 7 is a front elevational view of a shower head in unassembled form for receiving an insert assembly.
Figure 5:
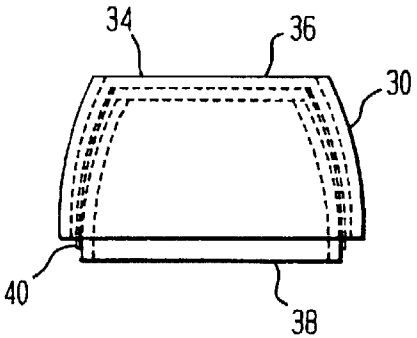
FIG. 5 is a front elevational view of an insert assembly in partially assembled form for receiving a decorative insert element.
Figure 6:
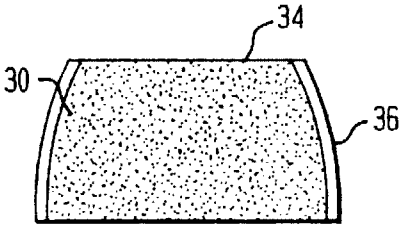
FIG. 6 is a front elevational view of the insert assembly in fully assembled form.

Referring now to FIGS. 5–7, there is shown an insert assembly generally designated by reference numeral 34 for use with the shower head SH as disclosed in FIGS. 1–3. In this regard, the insert assembly 34 is constructed from a pair of hollow cylindrical members 36, 38 having tapered sidewalls so as to conform to the tapered shape of the translucent portion 28 of the housing 10 of the shower head SH. The inner cylindrical member 38 is slightly smaller in outside diameter than the outer cylindrical member 36 so as to provide an annular receiving chamber 40 therebetween when the two members are nested together. The cylindrical members 36, 38 can be constructed from various synthetic polymer materials, such as acrylic-type polymers as housing 10. It is only required that the outer cylindrical member 36 be constructed of translucent material to allow visibility of the insert element 30.

The insert assembly 34 is assembled for use by nesting inner cylindrical member 38 within the outer cylindrical member 36 with an insert element 30 therebetween. Once assembled, the insert element 30 is visible through the sidewall of the translucent outer cylindrical member 36. The assembled insert assembly 34 may be positioned within the interior of the housing 10 of the shower head SH. Specifically, as shown in FIG. 7, the insert element 34 is positioned so as to be received within the receiving chamber 26 formed by a portion of the translucent portion 28 of the housing 10. In this manner, the insert assembly 34 simplifies the insertion and removal of the insert elements 30, as well as providing additional protection thereto. It is particularly noted that the insert assembly 34 is most useful where the insert elements 30 are formed from materials which do not have sufficient rigidity to be self supporting, e.g., thin pieces of cloth and the like.

Figures 8, 9:
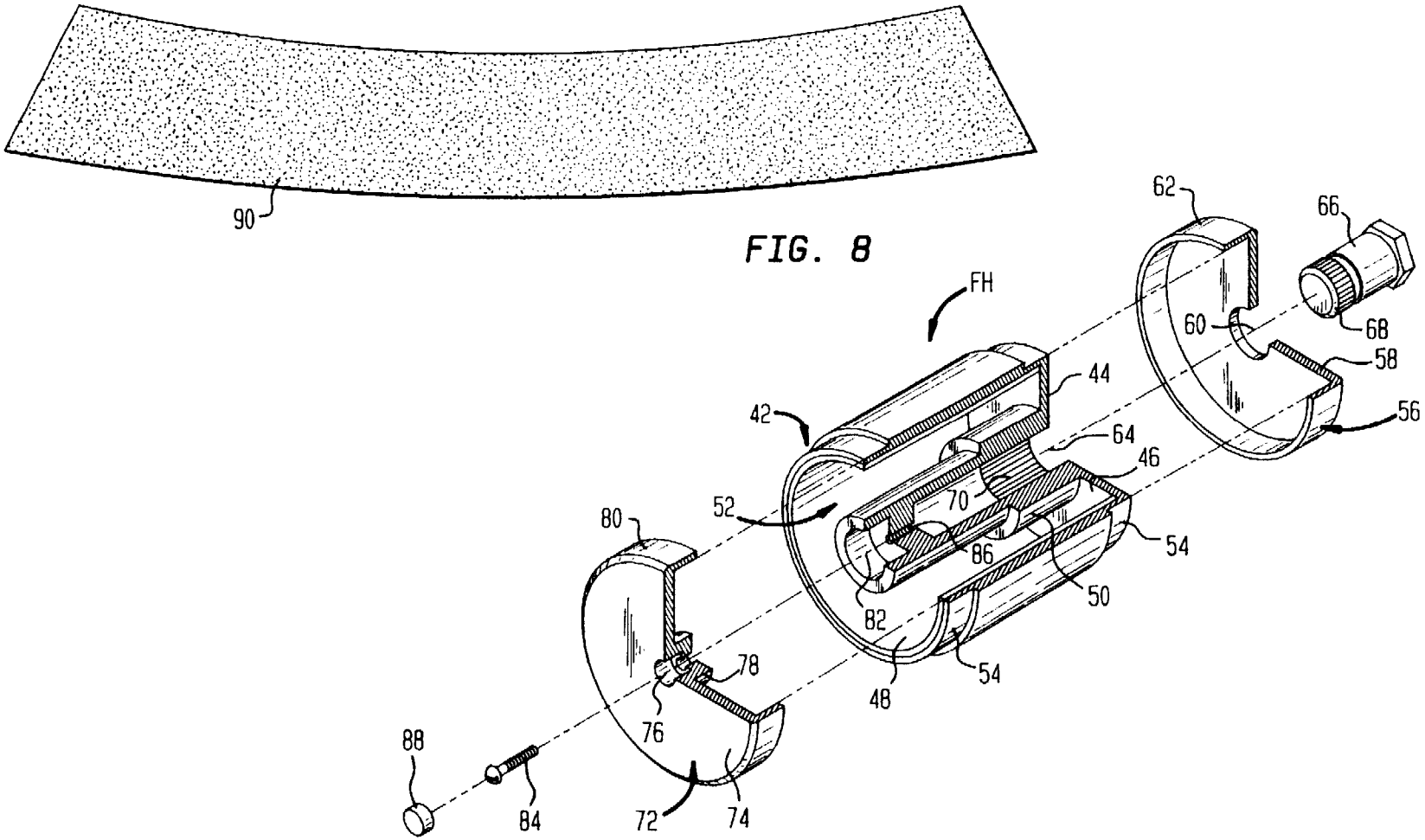
FIG. 8 is an exploded perspective view of a decorative faucet handle constructed in accordance with the present invention.
FIG. 9 is a top plan view of a template for cutting inserts for use in the faucet handle of the present invention.

Referring now to FIG. 8, there is shown a perspective unassembled view of a faucet handle generally designated FH constructed in accordance with another embodiment of the present invention. The faucet handle FH includes a housing 42 having a closed end 44 by means of endwall 46 and an opposing open end 48. An elongated cylindrical boss 50 extends from endwall 46 within the interior of the housing 42 to provide an annular receiving chamber 52. The receiving chamber 52 is formed adjacent a portion of the housing 42 which is generally of translucent material. In this regard, the housing 42 can be constructed from various plastic or polymer materials, such as acrylic-type materials in the manner of housing 10 previously described with respect to FIGS. 1–3. The housing 42, at either end thereof, is provided with a band 54 of reduced wall thickness.

An inner end cap 56 is constructed from a flat circular plate 58 having a central opening 60. The plate 58 is circumscribed by an upstanding wall 62. The end cap 56 is frictionally received over the closed end 44 of the housing 42. In assembled position, the wall 62 of the inner end cap 56 is received over the recessed band 54 of the housing 42 so as to provide a flush connection therebetween. The opening 60 is arranged in alignment with an opening 64 within the boss 50 for receiving one end of a valve stem 66. The valve stem 66, as is typical, has a plurality of teeth 68 which will mesh with a plurality of internal teeth 70 within the opening 64 of the boss 50. In this manner, rotation or lateral movement of the housing 42 will effect a corresponding motion of the valve stem 66 for operation of the faucet.

The open end 48 of the housing 42 is closed by an outer end cap 72. The outer end cap 72 is constructed from a flat circular plate 74 having a central opening 76 surrounded by a hollow cylindrical projection 78. The plate 74 is circumscribed by an upstanding wall 80. The outer end cap 72 is secured over the open end 48 of the housing 42 with wall 80 received over recessed band 54 to provide a flush arrangement. The outer end cap 72 is oriented by the projection 78 being releasably received within an opening 82 within the free end of the boss 50. The outer end cap 72 is secured to the boss 50 by means of a screw or bolt 84 received within a threaded opening 86 within the boss 50 which is in communication with the opening 82. A decorative screw cap 88 is received within the opening 76 to hide the screw 84. By removing the outer end cap 72, a decorative insert element 30 (not shown) may be positioned within the receiving chamber 52 to provide a decorative look which is visible from outside the housing 42 by means of the translucent portion.

Referring now to FIG. 9, there is shown a template 90 which is adapted to be used by the user for cutting a decorative insert element 30 into the proper shape for insertion into the receiving chamber of either the faucet handle FH or shower head SH as thus far described.

Although the present invention herein has been described with reference to specific versions, it is to be understood that the versions are merely illustrative of the principals and application of the present invention. It therefore will be understood that numerous modifications and variations may be made to the two embodiments and that other arrangements may be devised without departing from the spirit and scope of the present invention as defined by the claims.

What is claimed is:

1. A decorative fluid discharging fixture comprising a shower head, said shower head comprising a housing having a first portion and a removable end cap attached thereto, said housing having a fluid conducting passage extending therethrough for discharging a fluid through said end cap at one end thereof, and means within said housing forming a generally fluid-tight receiving chamber visible from the exterior of said fixture through a portion of said housing, said receiving chamber being accessible from outside said housing upon removal of said end cap whereby an insert element may be removably disposed within said receiving chamber while being visible from the exterior of said fixture.

2. The decorative fluid discharging fixture of claim 1, wherein said first portion of said housing comprises at least one generally translucent portion to which said end cap is detachably connected.

3. The decorative fluid discharging fixture of claim 2, wherein said means comprises a top element and a bottom element forming with a portion of said housing said generally fluid-tight receiving chamber accessible upon removal of said end cap.

4. The decorative fluid discharging fixture of claim 1, further including at least one selectively interchangeable insert element.

5. The decorative fluid discharging fixture of claim 4, wherein said insert element is at least one of a plurality of colored elements.

6. The decorative fluid discharging fixture of claim 4, wherein said insert element is at least one of a plurality of printed patterned elements.

7. The decorative fluid discharging fixture of claim 4, wherein said insert element includes individual pieces of decorative material.

8. The decorative fluid discharging fixture of claim 1, further including an insert assembly for said insert element, said insert assembly removably received within said receiving chamber.

9. The decorative fluid discharging fixture of claim 8, wherein said insert assembly comprises a pair of nestable members receiving said insert element therebetween.

10. A kit of parts for making a decorative fluid discharging fixture comprising a shower head, said shower head comprising a housing having a first portion and a removable end cap attached thereto, said housing having a fluid conducting passage extending therethrough for discharging a fluid through said end cap at one end thereof, said fluid conducting passage formed upon attaching said end can to said first portion, and means within said housing forming a generally fluid-tight receiving chamber visible from the exterior of said fixture through said housing, said receiving chamber being accessible from outside said housing upon removal of said end cap, and at least one of a plurality of insert elements to be selectively positioned by a user in said receiving chamber.

11. A decorative fluid discharging fixture comprising a housing element having a generally translucent portion and a pair of spaced apart open ends, one of said open ends connectable to a fluid source, said housing element having a hollow cylindrical first member attached within said housing element to said one open end to receive fluid from said source, an end cap having a fluid discharge first end and a second end detachably connectable to the other open end of said housing element, said end cap having a hollow cylindrical second member attached thereto for receiving fluid from said first member, said first and second members connectable to each other to form a fluid passageway from said fluid source to said discharge end of said end cap, and a generally fluid-tight annular receiving chamber formed within said translucent portion of said housing when said end cap is attached to said other end of said housing element, and at least one decorative insert element removably disposable within said receiving chamber through said other open end of said housing element thereby being visible from the exterior of said fixture through said translucent portion of said housing element.

12. The decorative fluid discharging fixture of claim 11, wherein said insert element is at least one of a plurality of colored elements.

13. The decorative fluid discharging fixture of claim 11, wherein said insert element is at least one of a plurality of printed patterned elements.

14. The decorative fluid discharging fixture of claim 11, wherein said insert element includes individual pieces of decorative material.

15. The decorative fluid discharging fixture of claim 11, wherein said fixture is a shower head.

16. The decorative fluid discharging fixture of claim 11, wherein said fixture is a faucet head.

17. The decorative fluid discharging fixture of claim 11, further including an inner shell forming with said translucent portion of said housing said receiving chamber therebetween.

18. The decorative fluid discharging fixture of claim 11, further including an insert assembly for said insert element, said insert assembly removably received within said receiving chamber, said insert assembly comprising a pair of nestable members receiving said insert element therebetween.

19. A decorative shower head comprising a support means having an inlet means for receiving fluid connected to a fluid supply pipe, an outlet means for dispensing said fluid, a generally cylindrical hollow member forming a fluid passage connecting said inlet means with said outlet means, a generally conical housing element connected at one end to said support means and coaxially disposed about said hollow member; said housing element forming a receiving chamber having at least one generally translucent segment at the generally medial portion of said housing element, an open end remote from said connected end of said housing element, and connecting means around said open end, an end element detachably connectable to said housing element to make said receiving chamber generally fluid-tight, said end element forming a portion of said generally cylindrical hollow member, and a selectively interchangeable insert element disposed for display in assembled position within said receiving chamber.

20. The decorative shower head of claim 17, wherein said selectively interchangeable insert element is at least one of a plurality of colored elements.

21. The decorative shower head of claim 19, wherein said selectively interchangeable insert element is at least one of a plurality of printed patterned elements.

22. The decorative shower head as claimed in claim 19, wherein said selectively interchangeable insert element includes individual pieces of decorative material.

23. The decorative fluid discharging fixture of claim 19, further including an inner shell forming with said translucent segment of said housing said receiving chamber therebetween.

24. A method of changing the decor of a decorative fluid discharging fixture comprising a shower head attached to a fluid supply source, said method comprising the steps of providing a decorative fluid discharging fixture having a housing containing a fluid conducting passage extending therethrough for discharging a fluid at one end thereof, and means within said housing forming a generally fluid-tight receiving chamber visible from the exterior of said fixture through a portion of said housing, said receiving chamber being accessible from outside said housing whereby an insert element may be removably disposed within said receiving chamber while being visible from the exterior of said fixture to receive an interchangeable insert element; disconnecting said fluid conducting passage within said decorative fluid discharging fixture to gain access to said receiving chamber; inserting said insert element into said receiving chamber for visible display through said housing; and reconnecting said fluid conducting passage within said discharging fixture for discharging of fluid.

* * * * *

UNITED STATES PATENT AND TRADEMARK OFFICE
CERTIFICATE OF CORRECTION

PATENT NO. : 5,779,146

DATED : July 14, 1998

INVENTOR(S) : Cutler

It is certified that error appears in the above-identified patent and that said Letters Patent is hereby corrected as shown below:

Column 8, line 60, "can" should read --cap--.

Column 10, line 15 "claim 17" should read --claim 19--.

Signed and Sealed this

Twentieth Day of October, 1998

*Attest:*

*Attesting Officer*

BRUCE LEHMAN

*Commissioner of Patents and Trademarks*